US009565944B2

(12) United States Patent
Yestadt

(10) Patent No.: US 9,565,944 B2
(45) Date of Patent: Feb. 14, 2017

(54) ADJUSTABLE HEIGHT FURNITURE AND METHOD

(71) Applicant: Frederick J. Yestadt, Larchmont, NY (US)

(72) Inventor: Frederick J. Yestadt, Larchmont, NY (US)

( * ) Notice: Subject to any disclaimer, the term of this patent is extended or adjusted under 35 U.S.C. 154(b) by 0 days.

(21) Appl. No.: 14/496,926

(22) Filed: Sep. 25, 2014

(65) Prior Publication Data

US 2015/0108797 A1 Apr. 23, 2015

Related U.S. Application Data

(62) Division of application No. 13/490,170, filed on Jun. 6, 2012, now Pat. No. 8,870,277.

(51) Int. Cl.

| | |
|---|---|
| ***A47C 13/00*** | (2006.01) |
| ***A47C 3/00*** | (2006.01) |
| ***A47C 3/04*** | (2006.01) |
| ***A47C 1/028*** | (2006.01) |

(52) U.S. Cl.
CPC ..... *A47C 3/00* (2013.01); *A47C 1/028* (2013.01); *A47C 3/04* (2013.01)

(58) Field of Classification Search
CPC ..... A47C 3/00; A47D 1/004
USPC ..... 297/1–3, 92, 93, 283.2, 130
See application file for complete search history.

(56) References Cited

U.S. PATENT DOCUMENTS

| | | | | |
|---|---|---|---|---|
| 326,241 | A * | 9/1885 | Preston | A47D 1/08 297/1 |
| 331,748 | A * | 12/1885 | Holden | B62B 7/12 280/30 |
| 389,163 | A * | 9/1888 | Nichols | B62B 7/12 280/30 |
| 3,175,861 | A * | 3/1965 | Tcherniavsky | A47C 1/028 297/93 |
| 3,330,596 | A * | 7/1967 | Wells | A47D 1/004 297/130 |
| 3,972,559 | A * | 8/1976 | Anacker | A47C 1/028 297/1 |
| 4,561,692 | A | 12/1985 | Yestadt et al. | |
| 6,155,641 | A | 12/2000 | Frost | |
| 6,340,168 | B1 | 1/2002 | Woleen | |
| 6,464,296 | B1 | 10/2002 | Sumner | |
| 7,416,248 | B2 * | 8/2008 | Rojas | A47C 4/30 297/1 |

FOREIGN PATENT DOCUMENTS

| | | | | |
|---|---|---|---|---|
| DE | 3422038 | A1 * | 12/1985 | A47C 1/028 |

* cited by examiner

*Primary Examiner* — Laurie K Cranmer
(74) *Attorney, Agent, or Firm* — Gregor N. Neff

(57) ABSTRACT

An adjustable height chair has a pair of side frames and a seat frame with two seat/backrest portions secured together, with the seat frame pivotably mounted in the side frames. The chair height is changed by rotating the side frames in a direction opposite to the rotation of the seat frame, so that a seat panel which previously served as a platform to sit on becomes a backrest, and vice-versa. The chair preferably has one or more crossbars to serve the double duty of strengthening the frame of the chair, and supporting the seat panels in both sitting positions of the chair.

6 Claims, 4 Drawing Sheets

FIG 1
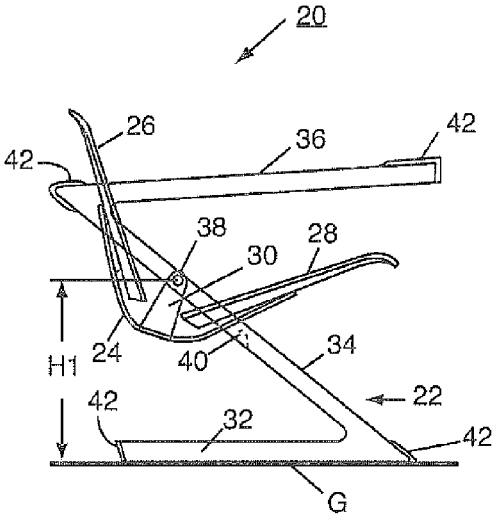
FIG 2
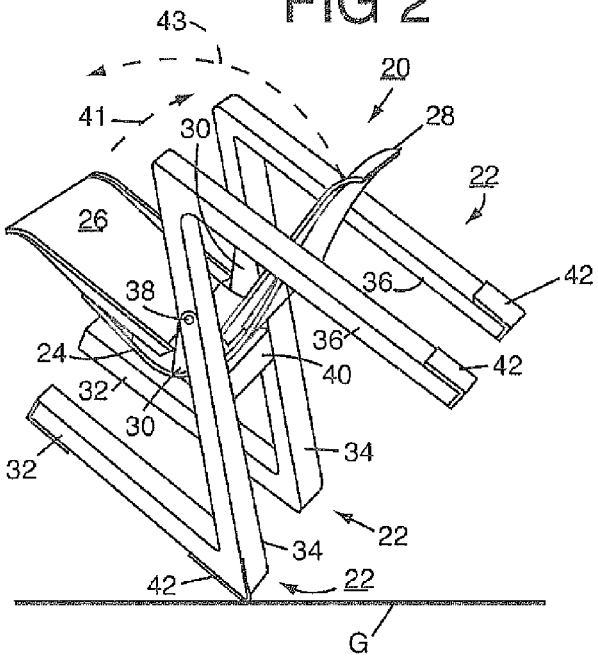
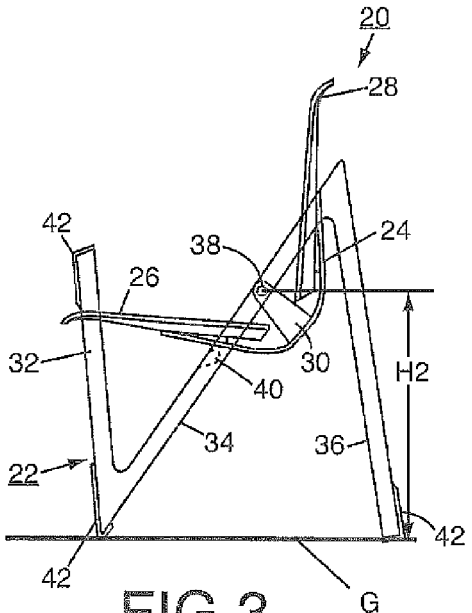
FIG 3
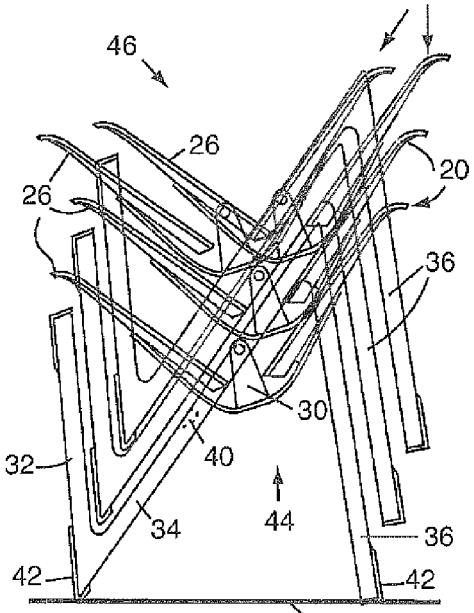
FIG 4

FIG 5
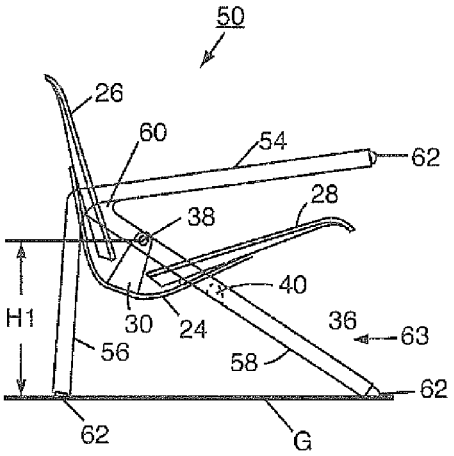
FIG 6
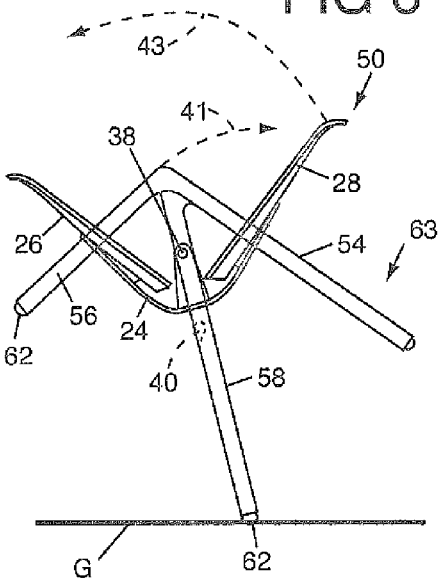
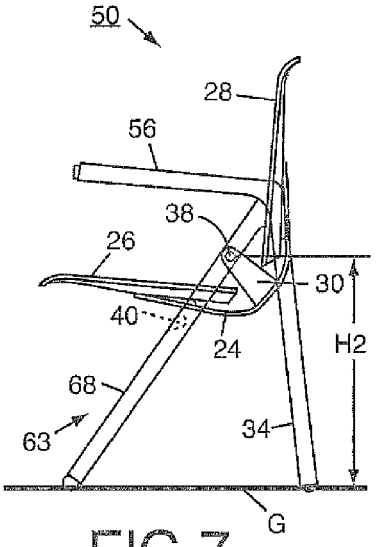
FIG 7
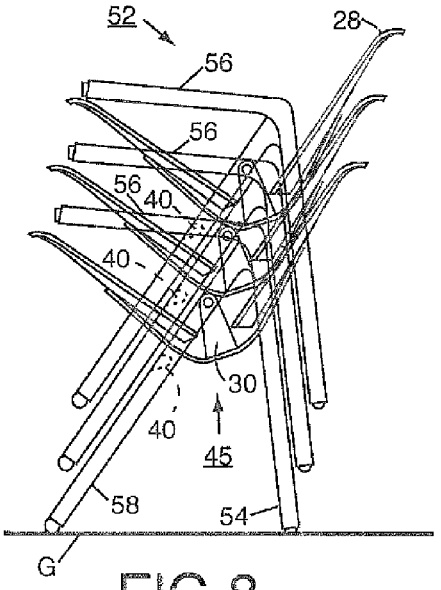
FIG 8

FIG 9
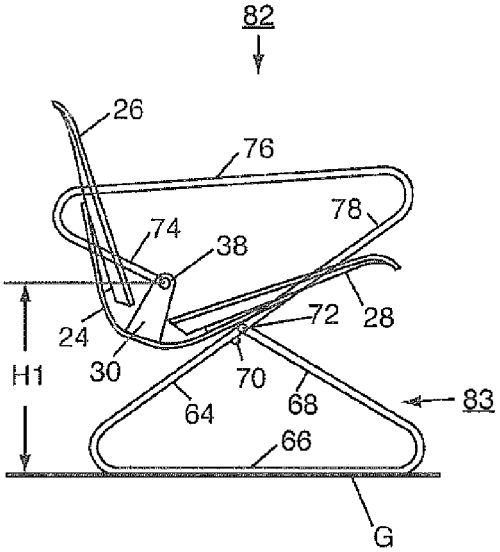
FIG 10
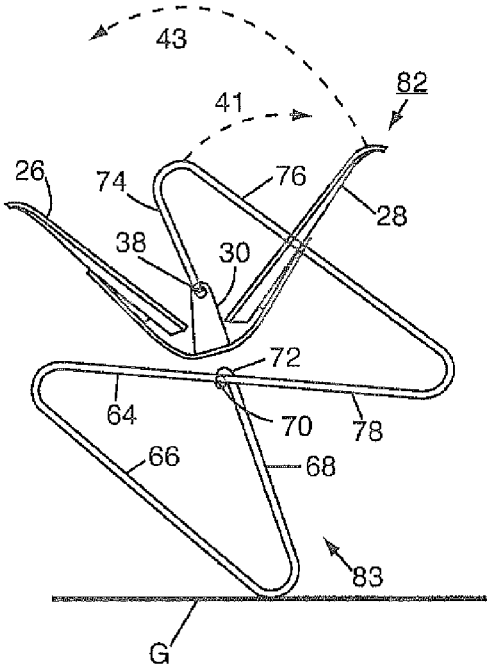
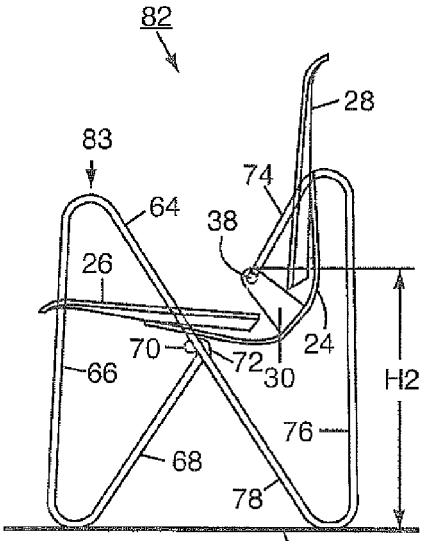
FIG 11
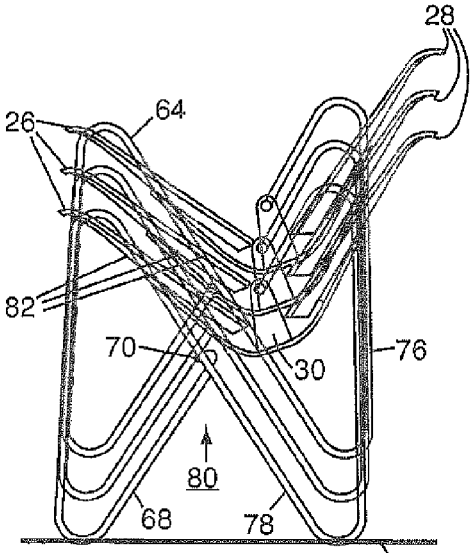
FIG 12

ADJUSTABLE HEIGHT FURNITURE AND METHOD

This invention relates to furniture which is adjustable in height, and methods of using such furniture. More specifically, this invention relates to chairs adjustable in height, and methods of using such chairs.

Adjustable height furniture, and particularly adjustable height chairs, are shown in my prior U.S. Pat. No. 4,561,692. The adjustable furniture shown there is highly desirable, but needs improvement to simplify its construction, reduce its manufacturing cost, and improve its utilization capabilities.

Accordingly, it is an object of the present invention to provide adjustable height furniture, and particularly adjustable height chairs, which serve the foregoing needs; chairs which are relatively simple in construction and easy to manufacture, are relatively lightweight, are relatively easy to adjust in height, and have other desirable features, such as a sleek, modern appearance, and stackability.

In accordance with the present invention, the foregoing objectives are met by the provision of adjustable furniture, in particular, adjustable chairs, in which there is a first frame having two platforms secured to one another at an angle, and a pair of second frames, with the first frame pivotably attached to the second frames and extending between them, and at least one cross member between the pair of opposed frames, and positioned to support one or both of the platforms when each is in seating position. The height is altered by rotating the first and second frames relative to one another to change the chair seat height.

In accordance with another embodiment of the invention, multiple cross bars are provided and extend between the second frames, each of the cross bars being located in a position to support one of the seat platforms when it is in a horizontal or nearly horizontal lower lounge seating position. The other cross-bar supports the other platform when it is in a horizontal or higher dining seating position.

Preferably, a pair of side frames is made so that in at least one position to which it can be adjusted, the legs for the structure extend at an angle towards one another with the large opening for the resulting V-shaped structure at the floor on which the furniture sits. In this manner, the leg structure of one of the chairs can rest upon the leg structure of one or more like chairs below it so that the chairs are easily stackable, one atop of the other, for compact storage.

Four different side frame shapes are provided; one having the appearance of a capital letter Z; another having the appearance simulating or suggesting a lower case letter Y, a third simulating the shape of a capital letter X; and the fourth being generally rectangular in shape.

The foregoing constructions are relatively lightweight, strong, attractive in appearance, and easy to handle in adjusting them from one height to another, stacking and otherwise.

The foregoing and other objects and advantages of the invention will be set forth in or apparent from the following description and drawings.

IN THE DRAWINGS

FIG. 1 is a side elevation view of one embodiment of the adjustable chair of the present invention in the lower lounge position;

FIG. 2 is a perspective and schematic view of the chair shown in FIG. 1 while in the process of being adjusted from one height to another;

FIG. 3 is a side elevation view of FIGS. 1 and 2 with the chair seat adjusted to a different higher dining height;

FIG. 4 is a side elevation and partly schematic view showing a plurality of the chairs in FIGS. 1-3 stacked atop of one another, thus demonstrating the stackability of the chair;

FIG. 5 is a side elevation view of another chair forming another embodiment of the present invention;

FIG. 6 is a side elevation and partly schematic view of the chair in FIG. 5 while it is being adjusted from one seat height to another;

FIG. 7 is a side elevation view of the chair of FIGS. 5 and 6 when it has been adjusted to a new higher seat height;

FIG. 8 is a side elevation and partially schematic view of a stack of the chairs shown in FIGS. 5-7 to demonstrate their stackability;

FIG. 9 is a side elevation view of another embodiment of the chair of the present invention;

FIG. 10 is a side elevation and partly schematic view of the chair of FIG. 9 while being adjusted to a new seat height;

FIG. 11 is a side elevation view of the chair shown in FIGS. 9 and 10 when adjusted to a new higher seat height;

FIG. 12 is a side elevation and partly schematic view of a plurality of the chairs shown in FIGS. 9-11 demonstrating their stackability;

"Z" TYPE CHAIR

Figure 13:
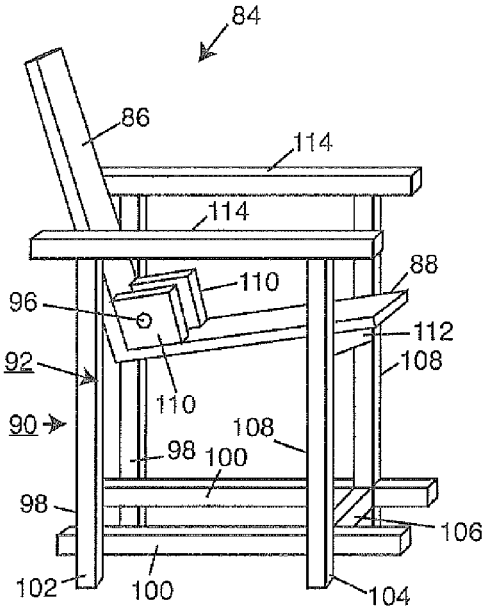
FIG. 13 is a side perspective view, partially broken away, of a chair comprising a further embodiment of the invention.

FIGS. 1 through 3 show an adjustable seat-height chair 20, referred to herein as a "Z" type chair. The chair 20 has a pair of side frames 22 (only FIG. 2 shows both frames), a seat frame 24 which is generally L-shaped in cross section, with seat/backrest elements 26 and 28 attached to the seat frame 24. A suspension arm or plate 30 is attached at one end to the seat frame 24 at the intersection between the two parts of the seat frame. At the end of the arm 30 farthest from the seat frame, is a pivotal fastener 38 which fits through a hole in a member 34 which is one of the members of the side frame 22 so as to make the seat frame 24 pivotable about the point 38.

Each of the two side frames 22 includes members 32, 34, and 36, with the portion 32 being adapted to sit on the floor or ground "G" and the members 36 serving as armrests when the seat structure is in the first orientation shown in FIG. 1. This structure looks like the letter "Z," and therefore sometimes is referred to as a "Z"-type chair.

With the chair 20 shown in the position of FIG. 1, the pivot point 38 is at a distance $H_1$ above the floor. In this orientation, the seat is in its low position, which can be called the "lounge" position.

As it is shown most clearly in FIG. 2, a cross member 40 extends between the opposite side frame members 22 in a position in which it serves the dual purpose of strengthening the chair structure, as well as serving as a stop member to support the seat portion of the seat structure in the position shown in FIG. 1. Advantageously, the position of the cross member 40 also supports the seat when the chair has been rotated to the position shown in FIG. 3 in which the height of the chair seat has been raised.

Padding is provided for the ends of the members 36, 34 and 32 to protect persons and other items from damage due to sharp edges, and padding (not shown) can be provided for the seat/backrest elements 26 and 28.

FIG. 2 illustrates the method used to convert the chair 20 from one, seating height to another. The outer frames 22 are rotated in the direction indicated by the arrow 41, while the seat frame is rotated in the opposite direction, indicated by the arrow 43 in FIG. 2.

FIG. 3 shows the resulting chair orientation when the structure shown in FIG. 1 has been rotated by approximately 90°. The seat frame 24 and the seat panels 26 and 28 have been rotated approximately 90° relative to the side frames 22 so that the panel 26 forms a seating surface whereas the panel 28 forms a backrest. The seat panel 26 rests on the same cross member 40 that supported the seat panel 28 in the FIG. 1 configuration of the chair.

The lengths of the frame members 32, 34, 36 are such that the pivot point 38 has been elevated to a new height $H_2$ which is significantly higher than $H_1$. Thus, the seat has been elevated to a new height, which makes the chair suitable for use at a dining table, or in other circumstances requiring chairs with higher seats.

It also can be seen that, because the seat frame 24 and the arms or plates 38 are relatively strong and stiff, the lateral stability of the chair is supported at a point spaced from the point of attachment of the cross member 40 so as to provide good lateral stability for the chair.

Referring now to FIG. 4, another advantage of this construction is that the shape of the side frames is such that, when the chair is in the FIG. 3 configuration, an acute angle is formed between the members 34 and 36, with the largest distance between those members being at floor level. This creates a triangular space, indicated at 44 in FIG. 4, which is very advantageous in allowing the vertical stacking of other chairs with identical frames atop of one another to stack them for compact storage.

The side frames and the cross-bar support structure described above make the two side frames of the chair relatively light in weight yet strong. Thus, members 32, 34 and 36 can be made of laminated plywood or metal tubing bent or welded together. This structure is strong. Also, the Z-shaped construction is somewhat springy.

"Y" Type Chair

FIGS. 5, 6 and 7 show another embodiment 50 of the invention. The adjustable chair 50 uses the same seat frame 24 and seat panels 26 and 28 and the arm or plate 30 with pivot point 38 as the chair in FIGS. 1-3, so that the same reference numerals will be used for those components appearing in FIGS. 5, 6 and 7. Two side frames 63 (only one of which appears in FIGS. 5-7) are provided in place of the side frames 22 shown in FIGS. 1-3.

Each side frame 63 comprises a first member 54 bent to form a second member 56 at somewhat more than 90° angle to member 54, and a third member 58 is attached at 60 to the junction of the sections 54 and 56 to form a somewhat "Y"-shaped structure. The chair is sometimes referred to as a "Y" type chair.

FIG. 6 illustrates how the chair 50 is rotated to convert the seat height from $H_1$ to a greater height $H_2$ as shown in FIG. 7.

Again, as in the side frames 22 in FIGS. 1-3, the frames 63 are rotated in a direction of arrow 41, and the seat frame 24 is rotated in the direction of arrow 43.

Of course, when it is stated that the seat frame and side frames are rotated in opposite directions, it should be understood that the rotation is relative, and that it can be achieved by rotating one frame and holding the other(s) stationary.

The result is shown in FIG. 7 with the members 54 and 58 providing legs for the chair and the member 56 providing arms for the chair. Thus, the chair has arms both in the lounge position shown in FIG. 5 and in the dining position shown in FIG. 7.

As in the FIGS. 1-3 embodiment, the cross member 40 extends between the two side frames 63 at a position in which it supports the seat panels 28 when the chair is in the position of FIG. 5, and also supports the seat panel 26 when the chair is in the position shown in FIG. 7.

FIG. 8 shows a plurality of the chairs 50 stacked together one atop of one another. This is facilitated, as in the FIGS. 1-3 embodiment, by the angular space 45 between the leg members 54 and 58 when the chair is in the FIG. 7 position. The cross members 40, as in the FIGS. 1-3 embodiment, cooperate in the fitting of the chairs together. Further, members 56 and 58 are approximately half the width of member 54, allowing members 56 and 58 to bypass one another in the stacking process.

Again, the frame members 54, 56 and 58 advantageously can be made of laminated plywood, steel tubing or other suitable materials.

"X" Type Chair

FIGS. 9, 10 and 11 show another embodiment 82 of the chair of the invention. Because the side frame elements somewhat resemble a capital letter "X," the chair sometimes is referred to as one "X" type or "FIG. 8" type of chair.

Again, the chair 82 uses the same seat frame 24 and seat panels 26 and 28, and the arm or plate 30 with a pivot point 38.

Each chair includes two side frames 83 which are different from the side frames 22 and 63 in the prior two embodiments of the invention already described. Each side frame is made up of preferably round steel tubing or solid steel bar which forms sections 64, 66 and 68 in lower portion of the chair, a cross member 70 serving a function like that of cross member 40 in the prior embodiments, and upper sections 76, 74 and 78. The pivot at 38 is located at the end of the tubing section 74.

Advantageously, the frames 83 can be formed from a single length of tubing or bar by bending it to form the junctions between sections 64, 66, 68, crossbar 70 and sections 74, 76 and 78. This frame is particularly advantageous because the upper portion of each side frame formed by sections 74, 76 and 78 is open between the point 38 and the point 70, so as to make the supports for the chair relatively springy and comfortable.

As with the prior embodiments of the invention, the chair is changed to provide a different seat height $H_2$ from the original seat height $H_1$ by rotating the seat frame 24 in the direction shown by the arrow 43, and side frames in the direction shown by the arrow 41. The result is the chair structure shown in FIG. 11, with the pivot point 38 at a new height $H_2$.

The cross member 70 again provides support for the each of the seats 26 and 28 when it is in seating position as shown in FIG. 9 or FIG. 11.

As it is shown in FIG. 12, a number of the chairs 82 can be stacked together easily, in the same manner as those shown in prior embodiments, due to the provision of the angular opening 80 between sections 68 and 78 of the two side frames. Again, the cross members 70 aid in supporting multiple chairs one atop of the other for easy stacking.

"Grid" Type Chair

Figure 14:
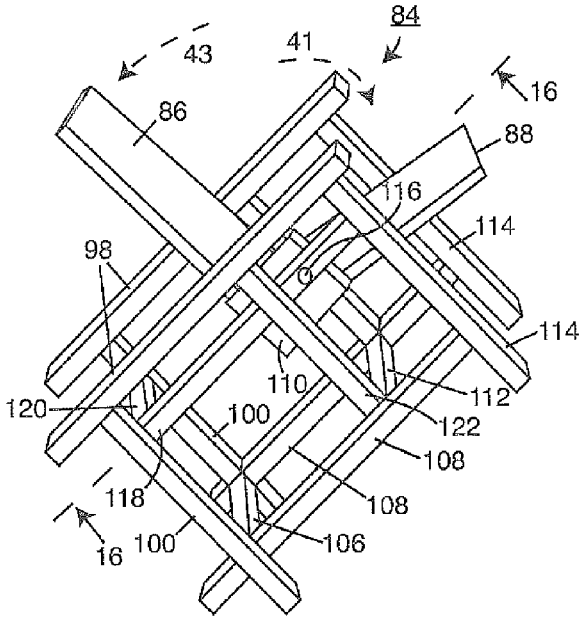
FIG. 14 is a perspective, partially schematic view of the chair of FIG. 13 while being moved to convert it to a chair of a new height.
Figure 15:
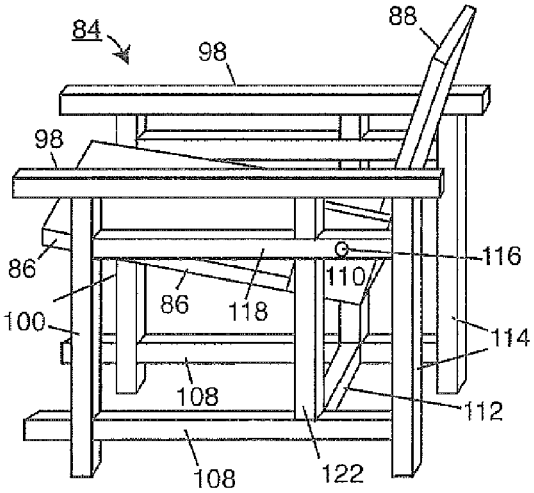
FIG. 15 is a side perspective view of the chair of FIGS. 13 and 14 when it has been adjusted to a new lower lounge seat height.

FIGS. 13, 14 and 15 show a further embodiment of the invention which is an adjustable height chair 84. Because the side frames form rectangular grids, the chair 84 sometimes is referred to as a "grid" type chair.

Chair 84 is similar to the chairs described above in that it has a seat frame consisting of two platforms 86 and 88 which are integrally fastened together at a substantial angle to one another, with a pivot plate 110 with a hole 96 secured to the seat frame on either side, at the junction between the two seat/seat back platforms 86 and 88.

Part of the side frames of the chair 84 have been omitted in FIG. 13 for the sake of clarity in showing the pivot plate 110 without obstruction. Those omitted parts are shown in FIGS. 14 and 15.

As in the chairs shown and described above, there are two side frames, 90 and 92 which have identical components bearing the same reference numerals. Each side frame has a pair of members 98 and 108 which serve as chair legs in the position of FIG. 13.

Crossbars 106, 120 and 112 extend between the side frames 90, 92 shown in FIGS. 13 and 14. Crossed members 118 and 122 support the pivot pin 116 and the pivot pin pivotably supporting the chair frame on the side frames.

As it can be seen in FIG. 13, the cross bars 112 and 120 serve the double purpose of improving lateral stability of the chair, while supporting the seat platform 88 in the near horizontal seating position shown in FIGS. 13 and 15 respectively.

The structure of FIG. 13 is rotated with the seat structure moving in the direction of arrow 43, and the frame structure moving in the direction of arrow 41. The seat frame rotates about the pivot point 116, and the chair configuration shown in FIG. 15 is the result. The pivot point 116 is at a substantially lower position than it is in the FIG. 15 position. The seat 86 is lower than the seat 88 in FIG. 13. In this condition, the member 86 serves as the seat, and the member 88 serves as the backrest of the chair. The seat member 86 is supported by the cross bar 120 (not visible in FIG. 15).

Advantageously, the frame members can be made of wood or square steel tubing, and the structure is strong and lighter in weight than some prior adjustable chairs of a similar type.

Figure 16:
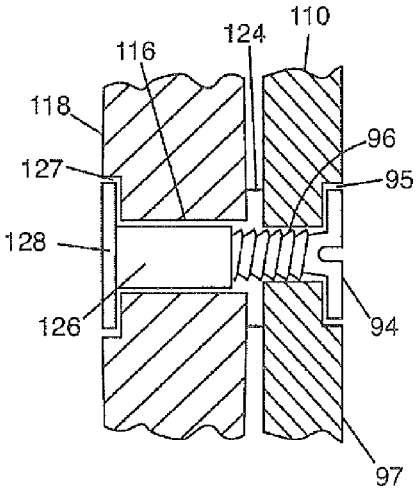
FIG. 16 is a broken-away cross-sectional view taken along line 16-16 of FIG. 14.

FIG. 16 is a cross-sectional view taken along line 16-16 of FIG. 14 and broken-away to permit sufficient enlargement. The plate 110 which is attached to the seat platforms 86 and 88 and has the hole 96 is pivotably attached to the side frame support member 118 through the hole 116.

A screw 94 whose head is seated in a recess 95 on the inside surface 97 of the plate 110 is threaded into a female threaded member 126 with a flat head 128 fitted into a recess 127 in the outer surface of the side frame support member 118. A nylon washer 124 provides some spacing between the members 110 and 118 and provides a low-friction bearing surface between the two elements. Preferably, the threads in the receptacle 126 and/or the threads for the screw 94 are given a lock-tight characteristic so as to minimize the chances that the parts will come loose without the deliberate use of a tool.

The screw 94 has a slotted head, but can have a hex head or other shaped head, as desired.

The head 128 similarly has engagement means such as a socket or slot, which is not shown in the drawings.

FIG. 16 also is representative of the connection formed between the plate or arm 38 shown in the invention embodiments of FIGS. 1-12, with the plate 110 corresponding to the arm or plate 30. The element 118 corresponds to the various structural members to which the arm 30 is pivoted at 38.

It should be understood that the fastening means shown in FIG. 16 is but one of many different pivot-forming and maintaining structures which can be used successfully in the function of attaching the chair frames to the side frames.

Although it is believed that ball-bearings or roller-bearings are not needed, such bearings can be used if desired.

In addition to the advantages mentioned above, the invention significantly reduces the cost, weight, and materials needed to supply furniture, and particularly chairs, of varying seat heights. Also, the invention saves space in dwellings, business offices, convention centers, catering halls, churches and other buildings in which chairs of different seat heights might be needed.

The above description of the invention is intended to be illustrative and not limiting. Various changes or modifications in the embodiments described may occur to those skilled in the art. These can be made without departing from the spirit or scope of the invention.

The invention claimed is:

1. A chair of adjustable height comprising a. a first frame having first and second sides and forming first and second platforms secured to one another at an angle, b. a second frame having a first side structure and a second side structure and at least one cross member secured to and extending between said first and second side structures, c. said first frame extending between and being pivotably attached at first and second pivot points to said first and second side structures of said second frame, d. each of said side structures of said second frame having at least one support leg structure which is stable in either of two rotational support positions rotationally spaced from one another and supporting said pivot points at two different heights above a horizontal support surface, e. a first one of said at least one cross member being positioned to support said first platform in a seat-forming position for said chair, with said second platform forming a backrest for said chair, when said side structures are in a first one of said rotational support positions, f. a second one of said at least one cross member extending between said side structures and positioned to support said second platform in a seat-forming position for said chair, with said first platform forming a back rest for said chair, when said side structures are in the second one of said rotational support positions, g. in which each of said side structures comprises a grid of attached structural elements including first and second elongated elements secured together at an angle to one another, said first element being longer than said second element, and, with said side structures in said first rotational position, said first element being upright to form a chair leg and said second element being supine to form an arm rest, and, with said side structures in said second rotational position, said first element being supine to form an arm rest and said second element being upright to form a leg.

2. A structure as in claim 1 including a third one of said at least one cross member extending between said side structures at a location spaced from both of said first and second cross-members and said pivot points.

3. A chair of adjustable height comprising a. a first frame having first and second sides and forming first and second platforms at an angle to one another, b. a second frame having a first side structure and a second side structure and at least one cross member secured to and extending between said first and second side structures, c. said first frame extending between and being pivotably attached at first and second pivot points to said first and second side structures of said second frame, d. each of said side structures of said second frame having at least one support leg structure which is stable in either of two rotational support positions rotationally spaced from one another and supporting said pivot points at two different heights above a horizontal support surface, e. a first one of said at least one cross member being positioned to support said first one of said platforms in a seat-forming position and provide structural stability to said chair when said side structures are in a first one of said rotational support positions, f. a second one of said at least one cross member extending between said side structures and positioned to support said second platform in a seat-forming position when said side structures are in the second one of said rotational support positions, g. in which each of said side structures comprises a grid of attached structural elements including first and second elongated elements secured together at an angle to one another, said first element being longer than said second element, and, with said side structures in said first rotational support position, said first element being upright to form a chair leg and said second element being supine to form an arm rest, and, with said side structures in said second rotational support position, said first element being supine to form an arm rest and said second element being upright to form a leg, in which each of said grids includes a third elongated element extending in the same direction as said first element and secured adjacent one end of said second element and with said first element forming a leg for said chair when said side structures are in said first rotational position, and a fourth elongated element extending in the same direction as said second element and secured adjacent one end of said first element and with said second element forming a leg for said chair when said side structures are in said second rotational position.

4. A structure as in claim 3 in which each of said grids includes at least one bearing support element secured into said grid, and a pair of bearing support members secured to one side of said first frame and pivotably attached to said bearing support element to rotationally support said first frame in said second frame.

5. A method of adjusting the height of an item of furniture, said method comprising A. providing:

a. a first frame having first and second sides and forming first and second platforms secured at an angle to one another, b. a second frame having a first side structure and a second side structure and at least one cross member secured to and extending between said first and second side structures, c. said first frame extending between and being pivotably attached at first and second pivot points to said first and second side structures of said second frame, d. each of said side structures of said second frame having at least one support leg structure which is stable in either of two support positions rotationally spaced from one another and supporting said pivot points at two different heights above a horizontal support surface, e. a first one of said at least one cross member being positioned to support said first platform in a seat-forming position for said chair, with said second platform forming a back rest for said chair, when said side structures are in a first one of said support positions, f. a second one of said at least one cross member extending between said side structures and positioned to support said second platform in a seat-forming position for said chair, with said first platform forming a back rest for said chair, when said side structures are in the second one of said support positions, g. each of said side structures comprising a grid of attached structural elements including first and second elongated elements secured together at an angle to one another, said first element being longer than said second element, and, with said structures in said first support position, said first element being upright to form a chair leg and said second element being supine to form an arm rest, and, with said side structures in said second support position, said first element being supine to form an arm rest and said second element being upright to form a leg, B. rotating said second frame relative to said first frame from one of said support positions to the other.

6. A method as in claim 5 in which said method includes providing a third one of said at least one cross member extending between said side structures at a location spaced from both of said first and second cross members and said pivot points.

* * * * *